US005395266A

United States Patent [19]

Abe et al.

[11] Patent Number: 5,395,266

[45] Date of Patent: Mar. 7, 1995

[54] WATER-PROOFING PLUG FOR CONNECTOR

[75] Inventors: Kimihiro Abe; Seiji Koumatsu, both of Shizuoka, Japan

[73] Assignee: Yazaki Corporation, Tokyo, Japan

[21] Appl. No.: 991,536

[22] Filed: Dec. 15, 1992

[30] Foreign Application Priority Data

Dec. 16, 1991 [JP] Japan ..... 3-331860

[51] Int. Cl.[6] ..... H01R 13/40

[52] U.S. Cl. ..... 439/587

[58] Field of Search ..... 439/274, 275, 278, 279, 439/587, 588, 589, 523, 730, 867

[56] References Cited

U.S. PATENT DOCUMENTS 4,961,713 10/1990 McCracken et al. ..... 439/587
5,098,315 3/1992 Scowen ..... 439/587
5,145,410 9/1992 Maetima et al. ..... 439/587
5,151,045 9/1992 Cravens et al. ..... 439/587 X
5,224,875 7/1993 Watanabe et al. ..... 439/587
5,240,433 8/1993 Kato ..... 439/587

FOREIGN PATENT DOCUMENTS 1121276 8/1989 Japan .

*Primary Examiner*—Khiem Nguyen

[57] ABSTRACT

A water-proofing plug for a connector which comprises: rubber plug including a cylinder having an electric wire inserting hole along the central axis, and a sealing portion 12*c* formed on the outer surface of one end portion of the cylinder in such a manner that the sealing portion is brought into close contact with the inner surface of a connector housing; and a reinforcing member including base plate having an electric wire inserting hole at the center, and supporting arms extending from both sides of the base plate, is so improved that the end faces of the supporting arms are sloped towards the electric wire inserting hole of the base plate, whereby the water-proofing plug is excellent in water-proofing ability and high in reliability in practical use.

4 Claims, 3 Drawing Sheets

WATER-PROOFING PLUG FOR CONNECTOR

BACKGROUND OF THE INVENTION

This invention relates to an improvement of a water-proofing plug for a connector used for connection of electric wires.

A water-proofing plug as shown in FIGS. 6 and 7 has been proposed by the present Applicant before (cf. Japanese Patent Application No. 121276/1989 laid open to the public on Aug. 17, 1989).

As shown in FIGS. 6 and 7, the waterproofing plug S comprises a rubber plug 1, and a reinforcing member 2 which is rigid. The rubber plug 1 is designed as follows: A sealing portion 1*c* is formed on the outer surface of one end portion of a cylinder 1*a* which has an electric wire inserting hole 1*b* along the central axis. The sealing portion 1*c* is elliptic in section so that it is brought into close contact with the inner surface of a connector housing. The other end portion of the cylinder 1*a* is formed into a connecting portion 1*d*, which is coupled to an electrical connecting piece. On the other hand, the reinforcing member 2 is designed as follows: Supporting arms 2*c* extend from both sides of an elliptic base plate 2*a* which has an electric wire inserting hole 2*b* at the center. The reinforcing member 2 is used in combination with the rubber plug 1 in such a manner that the supporting arms 2*c* of the former 2 are fitted in the sealing portion 1*c*.

The water-proofing plug S thus constructed suffers from the following difficulties:

The central axis of an electric wire 5 connected to the electrical connecting piece which is incorporated in the connector housing 3 with a rear holder 3*a*, is shifted to some extent from the central axis of the electrical connecting piece 4. Hence, when a force is applied to pull the electric wire along the central axis of the electric wire 5, the electrical connecting piece is raised, so that the end portions of a pair of stabilizers which extend from the tightening portion of the electrical connecting piece are brought into contact with the end faces 2*d* of the supporting arms 2*c* of the reinforcing member 2. In this case, the end faces 2*d* are substantially perpendicular to the central axis of the electric wire 5, and therefore the end portions of the stabilizers are brought into contact with the inner portions of the end faces. When the electric wire is further pulled, then the electrical connecting piece is further raised, so that the stabilizers 4*b* are spaced apart from each other, while the tightening portion 4*a* of the terminal goes into the space between the electric wire and the lower supporting leg 2*c*, which will greatly lower the terminal holding force, and the water-proofing characteristic of the water-proofing plug.

SUMMARY OF THE INVENTION

In view of the foregoing, an object of this invention is to provide a water-proofing plug for a connector which is made high both in water-proofing characteristic and in reliability, by increasing the terminal holding force of a reinforcing member forming the plug.

According to one aspect of the invention, there is provided a water-proofing plug for a connector which comprises a rubber plug including a cylinder having an electric wire inserting hole along the central axis, and a sealing portion formed on the outer surface of one end portion of the cylinder in such a manner that the sealing portion is brought into close contact with the inner surface of a connector housing, and a reinforcing member which is rigid and includes a base plate having an electric wire inserting hole at the center, and supporting arms extending from both sides of the base plate; in which the end faces of the supporting arms are sloped towards the electric wire inserting hole of the base plate, and the rubber plug is formed on the reinforcing member by molding.

In the water-proofing plug, the end faces of the supporting arms are inclined towards the electric wire inserting hole of the base plate. Hence, when a force is applied to pull the electric wire connected to the electrical connecting piece, the end portion of the tightening portion of the electric connecting piece is brought into contact with the inclined end face of the supporting arm, so that a force applied to the electric connecting piece is directed towards the center of the water-proofing plug. Therefore, the electrical connecting piece is never shifted from its predetermined position; that is, it is held stably at all times.

According to another aspect of the invention, there is provided a water-proofing plug for a connector which comprises a rubber plug including a cylinder having an electric wire inserting hole along the central axis, and a sealing portion formed on the outer surface of one end portion of the cylinder in such a manner that the sealing portion is brought into close contact with the inner surface of a connector housing, and a reinforcing member which is rigid and includes a base plate having an electric wire inserting hole at the center, and supporting arms extending from both sides of the base plate; in which the supporting arms of the reinforcing member are long enough to confront with the connecting portion of the rubber plug, and the rubber plug is formed on the reinforcing member by molding.

In the water-proofing plug, the stabilizers of the electric connecting piece connected to an electric wire are accommodated between the supporting arms extending from both sides of the reinforcing member in such a manner that they are embraced therewith. Hence, when a force is applied to pull the electric wire, the supporting arms act to support the stabilizers of the electric connecting piece, so that the terminal is positively and stably held.

The electric connecting piece together with the electric wire is secured to the connecting portion of the rubber plug with its tightening portion. The sealing portion of the rubber plug is held in close contact with the inner wall of the housing, thus preventing the entrance of water into the space between the electric connecting piece and the housing; that is, the electric connecting piece is sealingly held in the housing.

The nature, principle, and utility of the invention will be more clearly understood from the following detailed description of the invention when read in conjunction with the accompanying drawings.

BRIEF DESCRIPTION OF THE DRAWING(S)

DETAILED DESCRIPTION OF THE PREFERRED EMBODIMENTS

Preferred embodiments of this invention will be described with reference to the accompanying drawings.

Figure 1:
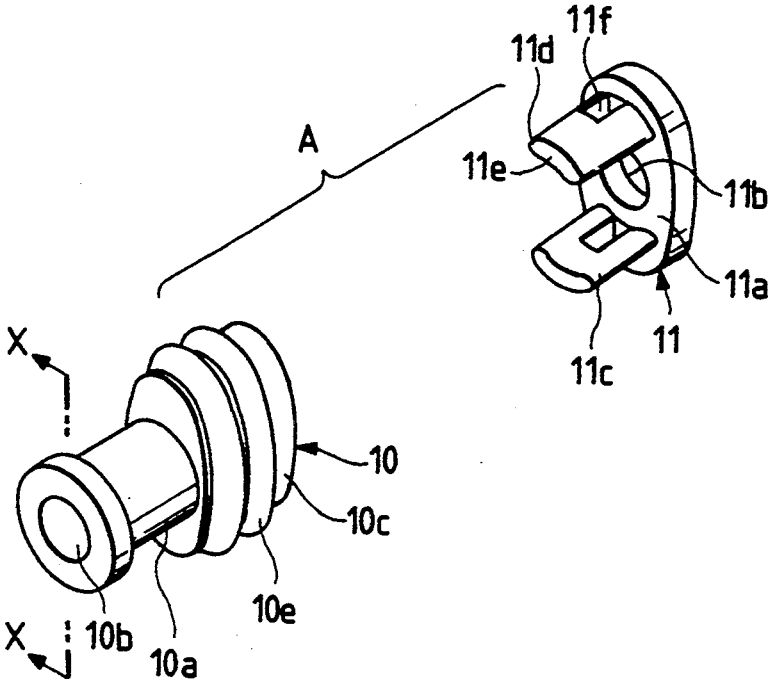
FIG. 1 is an exploded perspective view showing a rubber plug and a reinforcing member forming a first example of a water-proofing plug for a connector, which constitutes a first embodiment of the invention.
Figure 2:
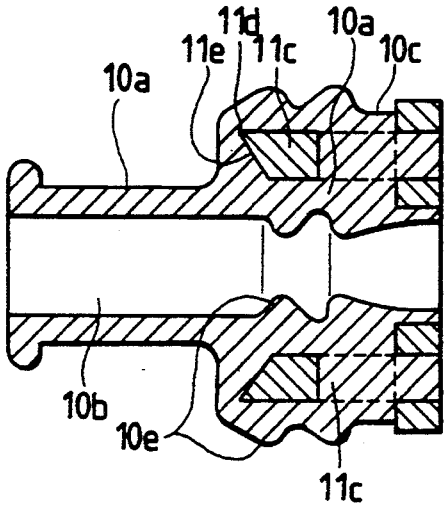
FIG. 2 is a sectional view taken along line X—X in FIG. 1, showing the water-proofing plug.

An example of a water-proofing plug for a connector, which constitutes a first embodiment of the invention, is as shown in FIGS. 1 and 2. That is, the water-proofing plug A according to the invention comprises: a rubber plug 10, and a reinforcing member 11 which is rigid. The rubber plug 10 is designed as follows: A sealing portion 10*c* is formed on the outer surface of one end portion of a cylinder 10*a* which has an electric wire inserting hole 10*b* along the central axis. The sealing portion 1*c* is elliptic in section so that it is brought into close contact with the inner surface of a connector housing (not shown). On the other hand, the reinforcing member 11 is designed as follows: Supporting arms 11*c* are extending from both sides of an elliptic base plate 11*a* which has an electric wire inserting hole 11*b* at the center. The tip end portions 11*d* of the supporting arms 11*c* have end faces 11*e* which are sloped gently towards the electric wire inserting hole 11*b* from outside. The reinforcing member 11 is combined with the rubber plug 10 in such a manner that the supporting arms 11*c* of the former 11 are fitted in the sealing portion 10*c*.

The reinforcing member 11 is formed by molding an insulating material of hard synthetic resin or the like in advance. Then, the rubber plug 10 is formed on the reinforcing member 11 by double-molding. In order to prevent the reinforcing member 11 from coming off the rubber plug 10, each of the supporting arms 11*c* has a rubber flow hole 11*f* in its base end portion; that is, a bridge is formed through the holes 11*f* between the rubber plug and the reinforcing member during molding.

The other end portion of the cylinder 10*a* of the rubber plug 10 is formed into a connecting portion 10*d* for an electrical connecting piece 4 (FIG. 3) which is connected to an electric wire. The inner surface of the cylinder 10*a*, and the outer surface of the sealing portion 10*c* are made wavy so as to increase the sealing effect.

Figure 3:
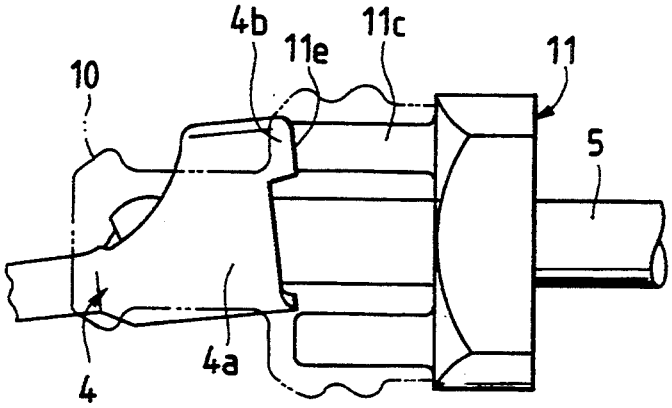
FIG. 3 is an explanatory diagram showing how the water-proofing plug is used.

When, during use of the water-proofing plug A, a force is applied to pull the electric wire 5 connected to the electrical connecting piece 4, as shown in FIG. 3, the stabilizers of the tightening portion 4*a* of the electrical connecting piece 4 are brought into contact with the sloped end face 11*e* of the supporting leg 11*c*. Hence, the sloped end face 11*e* acts to direct a force applied to the tightening portion 4*a* of the electrical connecting piece 4 towards the center of the water-proofing plug A. Therefore, the electrical connecting piece 4 is never shifted from its predetermined position; that is, it is held stably at all times.

Another example of the water-proofing plug, which constitutes a second embodiment of the invention will be described with reference to FIGS. 4 and 5.

Figure 4:
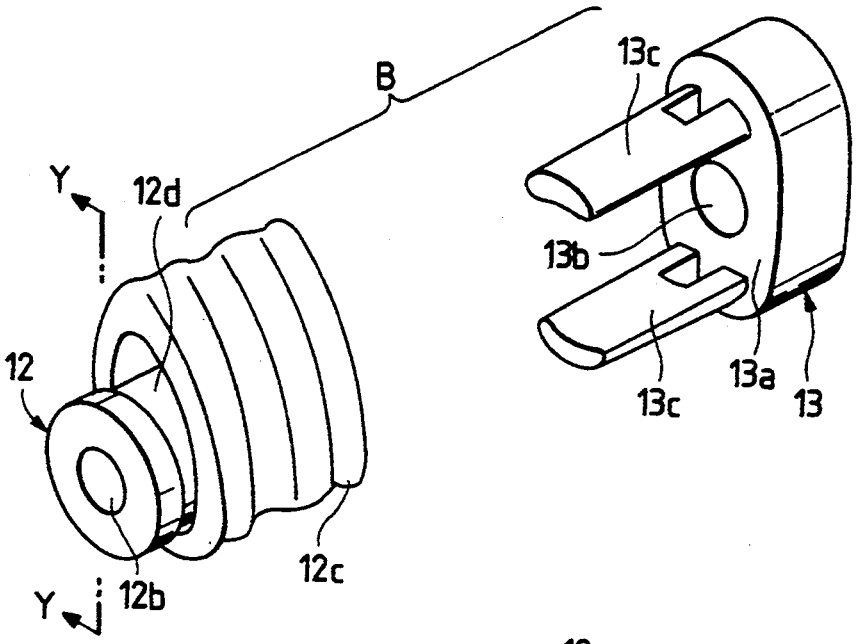
FIG. 4 is an exploded perspective view showing a rubber plug and a reinforcing member forming a second example of the water-proofing plug, which constitutes a second embodiment of the invention.

The water-proof plug B, as shown in FIG. 4, also comprises: a rubber plug 12, and a reinforcing member 13 which is rigid. The rubber plug 12 is designed as follows: A sealing portion 12*c* is formed on the outer surface of one end portion of a cylinder 12*a* which has an electric wire inserting hole 12*b* along the central axis. The sealing portion 12*c* is elliptic in section so that it is brought into close contact with the inner surface of a connector housing (not shown). On the other hand, the reinforcing member 13 is designed as follows: Supporting arms 13*c* are extending from both sides of an elliptic base plate 13*a* which has an electric wire inserting hole 13*b* at the center. Similarly as in the case of the above-described water-proofing plug A, the reinforcing member 13 is formed by molding an insulating material of hard synthetic resin or the like in advance, and then the rubber plug 12 is formed on the reinforcing member 13 by double-molding.

Figure 5:
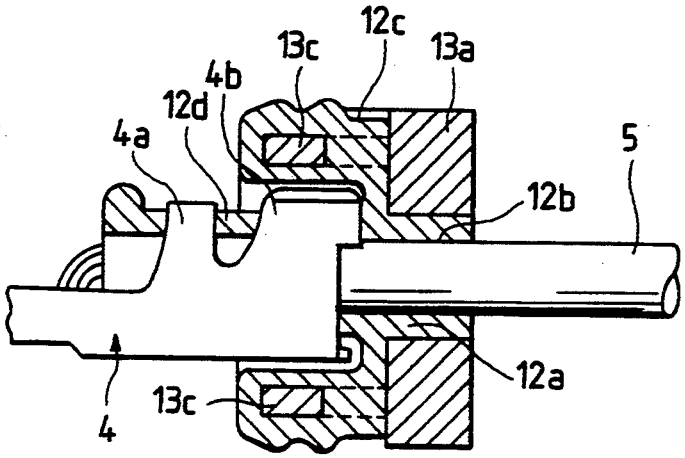
FIG. 5 is a sectional view taken along line Y—Y in FIG. 4, showing an electric connecting piece coupled to the water-proofing plug shown in FIG. 4.
Figure 6:
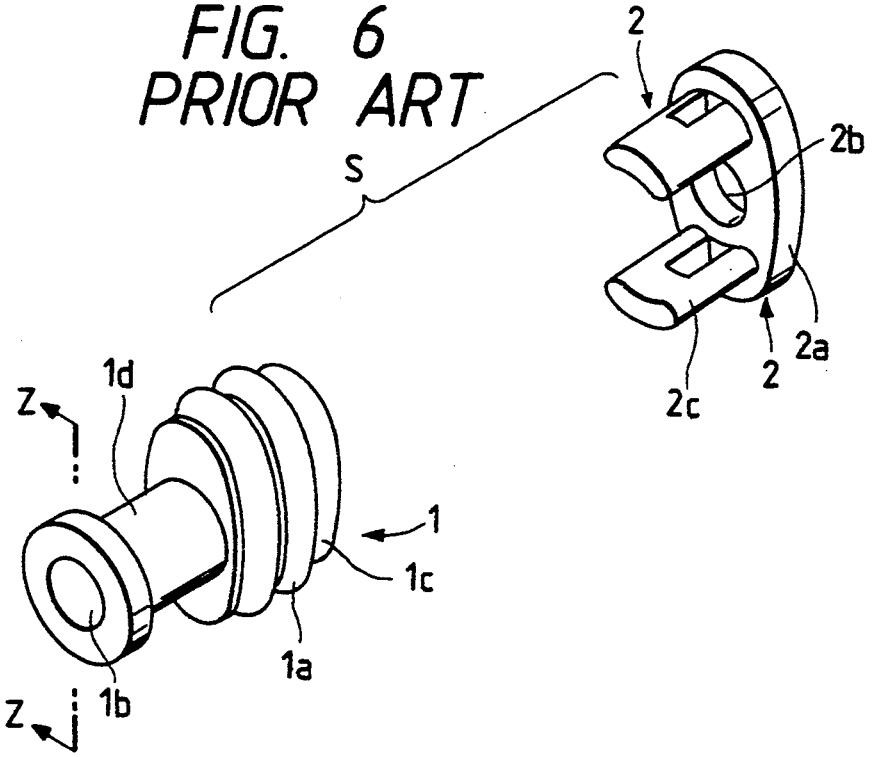
FIG. 6 PRIOR ART
FIG. 6 is an exploded perspective view showing a rubber plug and a reinforcing member forming a conventional water-proofing plug for a connector.
Figure 7:
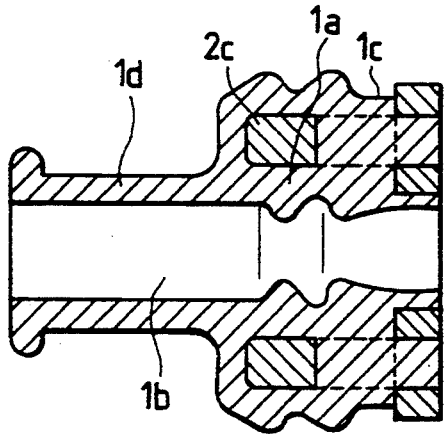
FIG. 7 PRIOR ART
FIG. 7 is a sectional view taken along line Z—Z in FIG. 6.

As is seen from FIG. 5 which is a sectional diagram showing the water-proofing plug B which accommodates the electrical connecting piece 4 connected to an electric wire 5, the supporting arms 13*c* of the reinforcing member 13 are extending to the extent that they confront with the connecting portion 12*d* of the rubber plug 12, and the stabilizers 4*b* of the electrical connecting piece 4, which is connected to the electric wire 5 and the connecting portion 12*d* with the tightening portion 4*a*, are accommodated between the supporting arms 13*c*.

Thus, the stabilizers 4*b* of the electric connecting piece 4 are embraced with or accommodated between the supporting arms 13*c*, while the end portions $4b_1$ of the stabilizers 4*b* are locked to the base plate 13*a* of the reinforcing member 13 through the cylinder 12*a* of the rubber plug 12. Hence, even when a force is applied to pull the electric wire, the electric connecting piece 4 is held at its predetermined position; that is, the water-proofing plug is outstanding both in terminal holding ability and water-proofing ability. Therefore, the water-proofing plug B, unlike the above-described water-proofing plug A, does not need the sloped end faces 11*e*.

As is apparent from the above description, even when a force is applied to pull the electric wire connected to the electrical connecting piece, the latter is positively and stably held owing to the action of the sloped end faces of the supporting arms of the reinforcing member forming the water-proofing plug or the embracing action of the supporting arms. This permits a reduction in width of water-proof connector; that is, a miniaturization of the latter, and results in an increases in terminal holding force and in water-proofing ability of the water-proofing plug.

While there has been described in connection with the preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A water proofing plug for a connector which comprises:

a rubber plug including a cylinder portion having an electric wire inserting hole along a central axis, and a sealing portion formed on an outer surface of one end portion of said cylinder portion in such a manner that said sealing portion is brought into close contact with an inner surface of a connector housing;

a reinforcing member which includes a base plate having an electric wire inserting hole at a center, and supporting arms extending from both sides of said base plate and being at least partially embedded in said sealing portion;

an electrical connecting piece connected to said wire for coupling said wire to another wire, said connecting piece being disposed at least partially around said cylinder portion; and means for preventing said electrical connecting piece from moving in a non-axial direction from a predetermined position even when an axial force is applied to said electric wires in an axial direction.

2. The plug according to claim 1, wherein said rubber plug is formed on said reinforcing member by molding.

3. The plug according to claim 2, wherein said reinforcing member is made of rigid material.

4. A water-proofing plug for a connector which comprises:

a rubber plug including a cylinder portion having an electric wire inserting hole along a central axis, and a sealing portion formed on an outer surface of one end portion of said cylinder portion in such a manner that said sealing portion is brought into close contact with an inner surface of a connector housing; and a rigid reinforcing member including a base plate having an electric wire inserting hole at the center, and supporting arms extending from both sides of said base plate, wherein said supporting arms having extreme distal end portions with front end faces which are sloped towards the electric wire inserting hole of said base plate, and said rubber plug is formed on said reinforcing member by molding.

* * * * *